US010865781B2

(12) United States Patent
Resch

(10) Patent No.: US 10,865,781 B2
(45) Date of Patent: Dec. 15, 2020

(54) CONNECTION COMPONENT OF A REFRIGERANT COMPRESSOR

(71) Applicant: Nidec Global Appliance Germany GmbH, Flensburg (DE)

(72) Inventor: Reinhard Resch, Feldbach (AT)

(73) Assignee: Nidec Global Appliance Germany GmbH, Flensburg (DE)

( * ) Notice: Subject to any disclaimer, the term of this patent is extended or adjusted under 35 U.S.C. 154(b) by 294 days.

(21) Appl. No.: 15/741,112

(22) PCT Filed: Jun. 30, 2016

(86) PCT No.: PCT/EP2016/065333
§ 371 (c)(1),
(2) Date: Dec. 29, 2017

(87) PCT Pub. No.: WO2017/001574
PCT Pub. Date: Jan. 5, 2017

(65) Prior Publication Data

US 2020/0032782 A1 Jan. 30, 2020

(30) Foreign Application Priority Data

Jun. 30, 2015 (AT) ..... GM50130/2015

(51) Int. Cl.
*F04B 39/00* (2006.01)
*F25D 23/00* (2006.01)

(52) U.S. Cl.
CPC ..... *F04B 39/0044* (2013.01); *F25D 23/006* (2013.01); *F25B 2500/13* (2013.01)

(58) Field of Classification Search
CPC . F04B 39/0044; F25D 23/006; F25B 2500/13
See application file for complete search history.

(56) References Cited

U.S. PATENT DOCUMENTS 2,551,514 A * 5/1951 Truelove ..... F25D 23/006 62/295
5,277,554 A * 1/1994 Elson ..... F04B 39/00 248/638
2009/0229290 A1 9/2009 Kim et al.

FOREIGN PATENT DOCUMENTS

JP 58195138 U 12/1983
JP 59188336 U 12/1984
(Continued)

OTHER PUBLICATIONS

Jang, Vibration Proof Apparatus for Compressor using Air Conditioner, Apr. 27, 2011, KR20110043252A, Whole Document (Year: 2011).*

(Continued)

*Primary Examiner* — Larry L Furdge
(74) *Attorney, Agent, or Firm* — McKee, Voorhees & Sease, PLC

(57) ABSTRACT

The invention relates to a connection component of a refrigerant compressor for joining a housing of the refrigerant compressor to a device that is in operative connection with the refrigerant compressor, the connection component comprising an inner element and an outer element surrounding the inner element, where the inner element has a higher stiffness than the outer element and the outer element has a functional segment that is designed so that in a loaded state of the connection component it is supported both at the housing and also at the device.

19 Claims, 5 Drawing Sheets

(56) References Cited

FOREIGN PATENT DOCUMENTS

| | | | | |
|---|---|---|---|---|
| JP | 6263439 | U | | 4/1987 |
| JP | 6488042 | A | | 4/1989 |
| JP | 200839039 | A | | 2/2008 |
| JP | 2009185775 | A | | 8/2009 |
| JP | 2010185447 | A | | 8/2010 |
| JP | 201226623 | A | | 2/2012 |
| KR | 20110043252 | A | * | 4/2011 |

OTHER PUBLICATIONS

Kusano, Refrigerator, Feb. 9, 2012, JP2012026623A, Whole Document (Year: 2012).*
Austrian Patent Office, Austrian Search Report in connection to GM 50130/2015 filed Jun. 30, 2015, 1 page, dated Nov. 25 2015.
"International Search Report" prepared Oct. 7, 2016 in connection to PCT/EP2016/065333, 3 pages, dated Oct. 25, 2016.
"Written Opinion of the International Searching Authority" prepared Oct. 7, 2016 in connection to 3 pages, dated Oct. 25, 2016 PCT/EP2016/065333,.
Machine Translation of JP2008039039(A), filed Feb. 28, 2008 by Denso Corp, accessed on Dec. 19, 2017.
Machine Translation of JP2009185775(A), filed Aug. 20, 2009 by Toshiba Corp et al, accessed on Dec. 19, 2017.
Machine Translation of JP2010185447(A), filed Aug. 26, 2010 by Hitachi Koki KK, accessed on Dec. 19, 2017.
Machine Translation of JP2012026623(A), filed Feb. 09, 2012 by Hitachi Appliances Inc, accessed on Dec. 19, 2017.
Machine Translation of JPS6488042(A), filed Apr. 3, 1989 by Matsushita Electric Ind Co Ltd, accessed on Dec. 19, 2017.
Machine Translation of JPS58195138(U), filed Dec. 26, 1983 by Unknown applicant, accessed on Dec. 19, 2017.
Machine Translation of JPS59188336(U), filed Dec. 13, 1984 by Unknown applicant, accessed on Dec. 19, 2017.

* cited by examiner

CONNECTION COMPONENT OF A REFRIGERANT COMPRESSOR

CROSS-REFERENCE TO RELATED APPLICATION

This application claims benefit under 35 U.S.C. § 119 or § 120 to Austrian application Serial No. AT GM 50130/2015 filed Jun. 30, 2015, herein incorporated by reference in its entirety.

FIELD OF THE INVENTION

This invention concerns a connection component of a refrigerant compressor for connecting a housing of the refrigerant compressor to a device that is in operative connection with the refrigerant compressor, preferably to a mounting panel of a refrigerator, the connection component comprising an inner element and an outer element surrounding the inner element, where the inner element has a higher stiffness than the outer element and where the outer element has a functional segment that is designed so that in a loaded state of the connection component it is supported both at the housing and also at the device, preferably the mounting panel, where in the loaded state a relative movement between the housing and the device and parallel to an axial direction exists and a pressure load parallel to the axial direction predominates, where a free space is provided, which, looking in a transverse direction, joins the functional segment of the outer element, where the inner element and the outer element are disposed one behind the other looking parallel to the transverse direction, and where in the loaded state of the connector component the functional segments deformed so that it at least partially projects into the free space.

BACKGROUND OF THE INVENTION

According to the prior art connection components are used for vibrational decoupling of a refrigerant compressor from a device that is in operative connection with the refrigerant [sic], in particular from a refrigerator. That is, the refrigerant compressor is joined or connected to the device via the connection components. The connection components usually comprise a sleeve, in particular made of metal, which is radially surrounded by a rubber element with a typical Shore A hardness of 40 to 50.

However, rubber usually has a number of disadvantages that have a negative effect on the vibrational decoupling. In particular, the high dynamic stiffness of rubber and its incompressibility in combination with the type of assembly, which, among other things, causes the connection component to have a high transverse stiffness, make a sufficiently good vibrational decoupling nearly impossible, especially at low frequencies.

On the other hand, rubber is nevertheless used for reasons of cost. Especially in the case of consumer products like refrigerators the pressure on costs is enormously high, due to which rubber is preferably used as the material.

SUMMARY OF THE INVENTION

It is therefore the aim of this invention to make available means that enable an improved vibrational decoupling between the refrigerator compressor and the device that is in operative connection with the refrigerant compressor, in particular cheaply.

The core of the invention for solving the above task is to provide a connection component that has a nonlinear spring constant. For this the static compressive prestress of the connection component, which comprises an inner element and an outer element surrounding the inner element, where the inner element has a higher stiffness than the outer element, lies in the vicinity of a critical load. This acts like a flat spot in the spring constant, at which the spring rate is very low. The corresponding spring constant curve thus has a nonlinear course. This in turn can be utilized to ensure that, in spite of a low static deflection, a low spring rate is achieved at the operating point.

On the other hand, in the case of a connection component with a purely linear spring constant the characteristic frequency of the sprung mass is only a function of the static deflection and gravitational acceleration. This means that a reduction of the characteristic frequency always goes hand in hand with a larger static deflection. For reasons of simple assembly and space requirements, however, a low static deflection is advantageous, which, with a linear spring constant curve, basically cannot be achieved at the same time as a reduction of the characteristic frequency. On the one hand, a low characteristic frequency is a prerequisite for a good vibrational decoupling at low frequencies, in particular in the range of 50 Hz to 160 Hz, which is particularly important in the case of speed-controlled compressors. On the other hand, a low characteristic frequency also improves the vibrational decoupling at higher frequencies.

According to the invention, such a nonlinear spring constant curve is achieved through the use of so-called geometric stiffnesses. According to the invention, a functional section of the outer element that, in a loaded state of the connection component, is supported both at the housing and at the device, is provided for this.

Support is in general understood to mean a direct or indirect support. That is, the supported functional section can contact the housing or the device directly or via, for example, at least one connector element, which is connected to the housing or the device at least in a loaded state.

In what follows, a loaded state of the connection component is always to be understood to mean that at least one compressive component that runs parallel to an axial direction is present. Correspondingly, the said loaded state of the connection component exists chiefly when there are relative movements of the housing and the device with respect to each other and parallel to the axial direction. Preferably, a lengthwise axis of the connection component runs parallel to the axial direction.

Further, according to the invention a free space is provided, preferably in the form of a gap, which joins the functional segment in a transverse direction, which runs transversely, preferably normal, to the axial direction. Basically, the free space or the gap, looking from the functional segment outward in the direction of the inner element or in the opposite direction, can join the functional segment. Preferably, the free space or gap is free in an unloaded state of the connection component, where in an unloaded state no compressive component is present in the axial direction.

In order to ensure a flat spring constant curve of the connection component at the operating point, the outer element or its functional segment is designed so that in the loaded state it is deformed compared to the unloaded state when a predefined pressure prevails parallel to the axial direction in the loaded state. Preferably, the functional segment deforms so that it protrudes into the free space or gap. That is, the functional segment can basically deform in the direction toward the inner element or in the opposite direction, in each case depending on how the free space or gap is disposed relative to the functional segment. In particular, the functional segment can deform so that a middle segment of the functional segment bulges into the free space.

Therefore, in the case of a connection component of a refrigerant compressor for connecting a housing of the refrigerant compressor to a device that is in operative connection with the refrigerant compressor, preferably to a mounting panel of a refrigerator, the connection component comprising an inner element and an outer element surrounding the inner element, where the inner element has a higher stiffness than the outer element and where the outer element has a functional segment that is designed so that in a loaded state of the connection component it is supported both at the housing and at the device, preferably the mounting panel, it is provided according to the invention that a free space is provided, which, looking in a transverse direction, joins the functional segment of the outer element, where the inner element and the outer element, looking parallel to the transverse direction, are disposed one behind the other and where in a loaded state of the connection component the functional segment is deformed so that it protrudes at least in part into the free space.

The inner and the outer element can have essentially circular cross sections. In this case the outer element surrounds the inner element radially.

Preferably, the functional segment can be designed so that its deformation takes place as a buckling. Correspondingly, in a preferred embodiment of the connection component according to the invention, it is provided that the deformed functional segment comprises a segment with a bend, where the segment of the functional segment having the bend protrudes at least in part into the free space.

In order to further stabilize this now unstable system, if the axial forces are too high, in a preferred embodiment of the connection component according to the invention it is provided that in the loaded state of the connection component the deformed functional segment at least in part abuts an abutment member of the connection component, which abutment member, looking in the transverse direction, joins the free space. Through this a still greater deformation or buckling of the functional segment is suppressed.

A constructively especially simple and cheap production of the connection component according to the invention is enabled in that the functional segment deforms or buckles in the direction of the inner element and abuts on the inner element. Preferably, the inner element does not become deformed in the loaded state. Preferably, the inner element in the loaded state is not supported at the housing and device at the same time; especially preferably it is supported only at the housing or only at the device. Correspondingly, in a preferred embodiment of the connection component according to the invention it is provided that the abutment member of the connection component is formed by the inner element.

In a preferred embodiment of the connection component according to the invention it is provided that the outer element has an inner segment closer to the inner element, and an outer segment, where the functional segment is formed by one of the two segments and of the two segments only the functional segment in the loaded state of the connection component is supported both at the housing and also at the device, preferably the mounting panel.

The outer segment, looking in the transverse direction and outward, is disposed behind the inner segment, where the transverse direction stands across, preferably normal to the axial direction.

Preferably, each of the outer and the inner segment has an essentially circular cross section.

The said loaded state does not preclude that other loaded states also exist, in which both segments are supported both at the housing and also at the device. For example, conceivable is a stepped support of a segment, in which stepped support the said segment is supported exclusively at the housing or at the device in the loaded state and in which stepped support said segment in another loaded state with a further elevated compressive component is supported parallel to the axial direction both at the housing and also at the device. Such an additionally elevated compressive component preferably can be adjusted parallel to the axial direction in case that the housing moves closer to the device.

In order to make available space for the deformation or the buckling of the segment that forms the functional segment and thus a controlled deformation or a controlled buckling of the said segment, it is provided in a preferred embodiment of the connection component according to the invention that the free space is formed at least in part between the inner segment and the outer segment. That is, the free space allows the segment that is supported both at the housing and also at the device in the loaded state of the connection component to deform in the direction of the other segment.

In order, at high compressive stresses, at which the segment forming the functional segment is deformed, to further stabilize the now unstable system, in a preferred embodiment of the connection component according to the invention it is provided that the abutment member is formed by the other of the two segments. That is, the segment forming the functional segment is supported at the other segment. Preferably, the other segment does not itself deform or does not itself bend.

To prevent the deformation or buckling of the other segment and thus to enable a support of the deformed or buckled segment at the other segment, the other segment in the loaded state is supported only at the housing or the device, but not on both at the same time. Preferably, the adjacent segment thus is supported by an end region at the housing or the device and another end region of the adjacent segment can move with respect to the device or the housing in the loaded state or is free with respect to the device or the housing.

The degree of instability of the system or the outer element at lower loads can be adjusted through the choice of the wall thickness of the deforming segment. A sufficiently large wall thickness in this case prevents too great an instability at low load. Since the other segment primarily need only fulfill a supporting function for the deforming segment, its wall strength can be kept relatively low. In a preferred embodiment of the connection component according to the invention it is therefore provided that the functional segment, looking in the transverse direction, have, at least in part, a greater wall thickness than the other one of the two segments. In this way it is even possible to save on material in the case of the other segment. The wall thickness in this case is preferably measured in the unloaded state of the connection component.

In order to reliably ensure a supporting or abutting of the deforming segment at the other segment, the other segment must be appropriately dimensioned in the axial direction, in particular in relation to the deforming segment. Correspondingly, in a preferred embodiment of the connection component according to the invention it is provided that the functional segment in the unloaded state of the connection component, looking in an axial direction, has a shorter length than the other of the two segments, where the transverse direction runs transverse to the axial direction.

In correspondence with the deformation of the deforming segment in a preferred embodiment of the connection component according to the invention it is provided that the functional segment, looking in an axial direction, have a greater length in the unloaded state of the connection component than in the loaded state of the connection component, where the transverse direction runs transverse to the axial direction. The deformation can therefore basically speaking be any deformation, as long as it leads to a reduction in the length of the deforming segment, looking in the axial direction.

In order to enable a realization of the outer element that is especially simple in design and easy to manufacture, in an especially preferred embodiment of the connection component according to the invention it is provided that the functional segment is formed by the outer segment.

The two segments, looking in the axial direction, respectively have a first and a second end region. In order to enable a realization of the outer element that is especially simple in design and easy to manufacture, it is provided in a preferred embodiment of the connection component according to the invention that the two segments are joined together, preferably in the region of an end region of the relevant segment. In addition, an undesired too great instability of the outer element at high compressive loads is counteracted by the connection of the two segments.

In order in particular to simplify the assembly or the production of the connection component, in a preferred embodiment of the connection component according to the invention it is provided that the outer element is made in one piece.

Preferably, the outer element is elastic and not very compressible to incompressible. Correspondingly, in a preferred embodiment of the connection component according to the invention it is provided that the outer element is made of rubber or an elastomer. In this case the rubber can be made from a natural material as well as from a synthetic material, in particular raw natural rubber. The elastomer is correspondingly not very compressible to incompressible.

Similar to what was said above, according to the invention a refrigerant compressor is provided that comprises a hermetically sealed housing and a drive unit with a piston-cylinder unit disposed within the housing for cyclical compression of a refrigerant and an electric motor to drive the piston-cylinder unit, where the refrigerant compressor additionally comprises at least one connection component according to the invention for joining the housing to a device that is in operative connection with the refrigerant compressor, preferably to a mounting panel of a refrigerator.

Further, commensurate with the above, according to the invention a system is provided that comprises the system according to the invention comprising a refrigerant compressor according to the invention and a device that is in operative connection with the refrigerant compressor, preferably a refrigerator, where the device comprises a mounting panel, to which the housing of the refrigerant compressor is joined with the at least one connection component, where in the loaded state of the connection component the functional segment is supported both at the housing and at the mounting panel.

In order to ensure that in the loaded state the abutment member, in particular the other, nondeforming segment, can be supported only at the housing, in a preferred embodiment of the system according to the invention it is provided that an opening and/or a recess and/or a step is provided in the mounting panel, into which in the loaded state of the connection component the abutment member protrudes. Preferably, the abutment member, in particular the part of the other segment with which the other segment in the loaded state protrudes into the opening, recess, or step of the mounting panel, moves toward the mounting panel when there is a transition from the unloaded state to the loaded state. Preferably, the abutment member, in particular the other segment, does not protrude into the opening, recess, or step of the mounting panel in the unloaded state.

BRIEF DESCRIPTION OF THE FIGURES

The invention will now be explained in more detail by means of an embodiment example. The drawings are exemplary and are intended to represent the ideas of the invention, but not to limit it in any way or even to present it in a final form.

Here.

DETAILED DESCRIPTION OF EXEMPLARY EMBODIMENTS OF THE INVENTION

Figure 1:
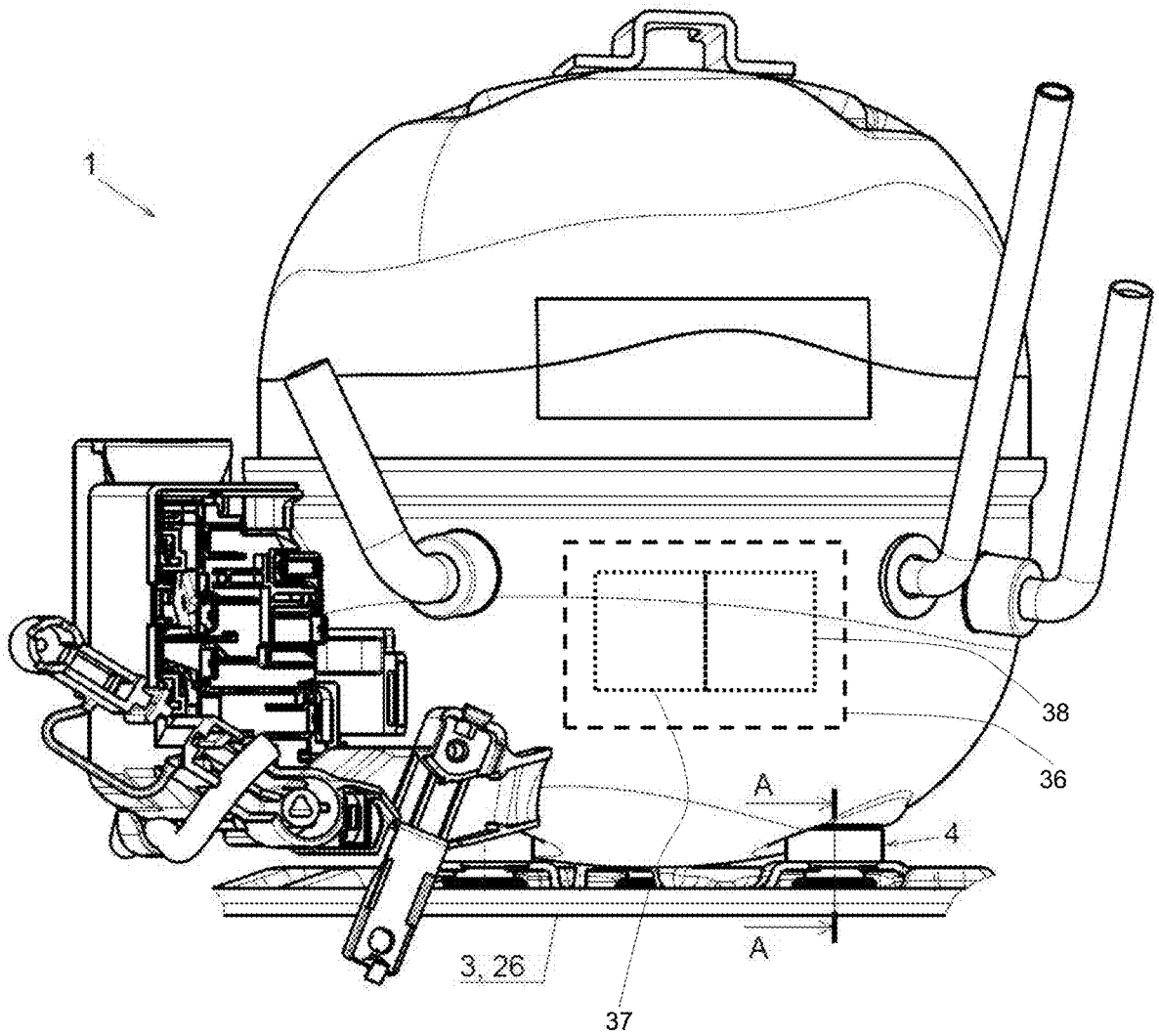
FIG. 1 shows a side view of a refrigerant compressor.

In the side view in FIG. 1 one can see a refrigerant compressor 1 with a housing 2, where within the housing 2 there is a drive unit 36 with a piston-cylinder unit 37 for cyclic compression of a refrigerant and an electric motor 38 to drive the piston-cylinder unit 37. The housing 2 in FIG. 1 is connected via connection components 4 according to the prior art with a mounting panel 26 of a refrigerator 3, which is in operative interaction with the refrigerant compressor 1.

Figure 2:
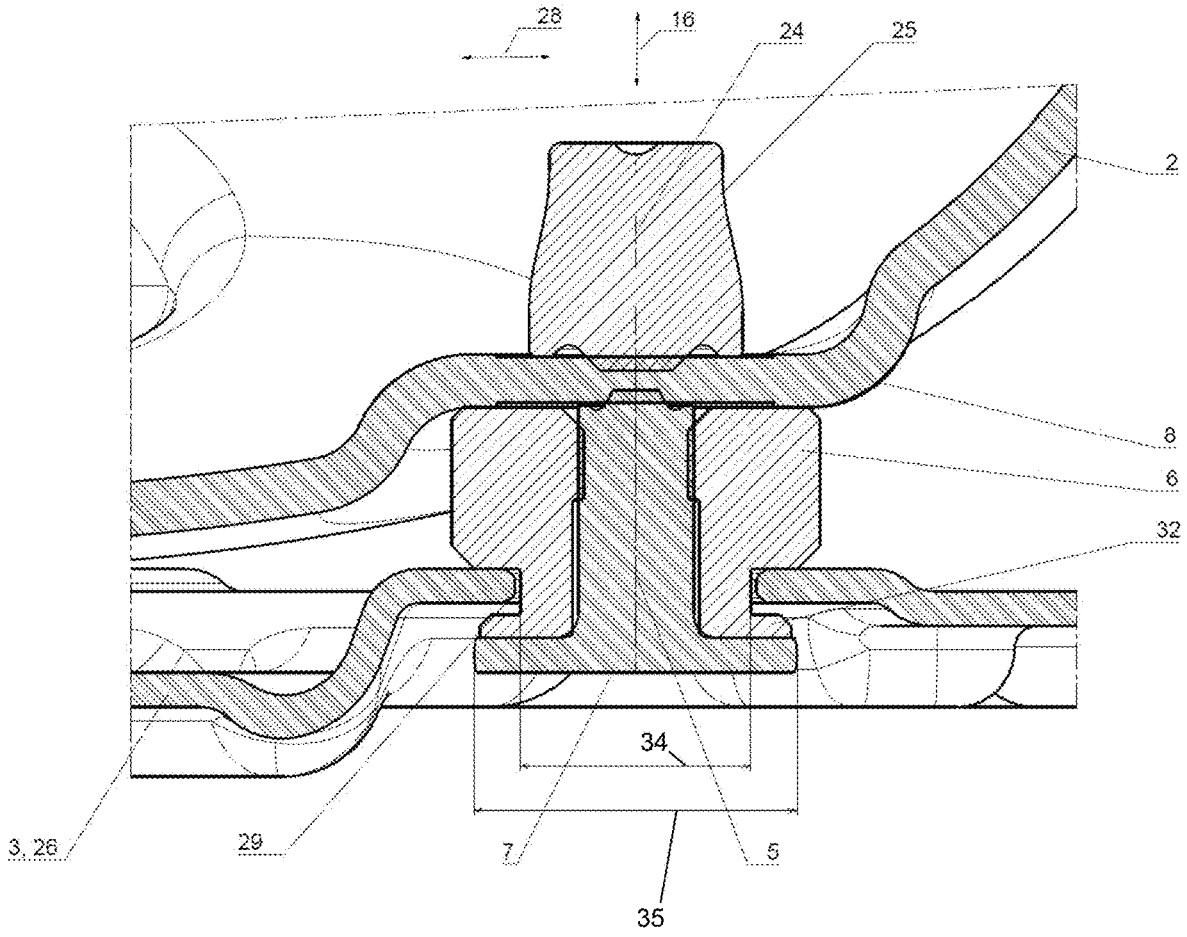
FIG. 2 shows a sectional view through a connection component known from the prior art, through cut line A-A in FIG. 1.

As can be seen in the sectional view in FIG. 2, the connection components 4 according to the prior art have an inner element 5 and an outer element 6 that surrounds the inner element 5. The outer element 6 is typically made of rubber. The inner element 5 in any case has a greater stiffness than the outer element 6, which counteracts a settling of the outer element 6.

The connection element 4 has a lengthwise axis 24, which runs parallel to an axial direction 16. A transverse direction 28 stands across, preferably normal, to the axial direction 16. The lengthwise axis 24, looking in the transverse direction 28, runs through the center of the connection element 4. Looking outward from the lengthwise axis 24 in the transverse direction 28, the outer element 6 is disposed behind the inner element 5.

The inner element 5 can be made in the shape of a sleeve, which allows a screw (not shown) to be passed through it in order to join the connection element 4 to the housing 2. In FIG. 2 (as in FIGS. 3 and 4) one can also see a steel spring bolt 25, onto which a spring (not shown) can be pressed, by means of which the drive unit 36 (see FIG. 1) is mounted in housing 2.

According to the prior art solutions are employed in which the outer element 6 is closed entirely around the lengthwise axis 24, in particular by parts of the device 3, preferably by the mounting panel 26, as can be seen in FIG. 2. Thus, the incompressibility of rubber can fully come to bear in the interplay with the stiffening effect of the inner element 5, since the shear deformability of rubber cannot be utilized. This prevents a vibrational decoupling between the refrigerant compressor 1 and the refrigerator 3.

Further, the inner element 5 in this embodiment example forms a transport securing means 7 at its free end, looking in the axial direction 16, in that the inner element 5 becomes wider in the transverse direction 28 there. This results in a recess 35 of the transport securing means 7 being greater in the transverse direction 28 than a recess 34 of an opening 29 in the mounting panel 26, through which opening 29 the inner element 5 and the outer element 6 are inserted in axial direction 16. This in turn keeps the refrigerant compressor 1 from being able to pull away from the mounting panel 26 in the axial direction 16.

The outer element 6 forms a cushioning layer 32 over the transport securing means 7. The cushioning layer 32 prevents a hard, metallic contact from occurring between the transport securing means 7 and the mounting panel 26, in particular if the refrigerant compressor 1 should be improperly mounted and refrigerant compressor 1 and mounting panel 26 should be pretensioned with respect to each other.

Figure 3:
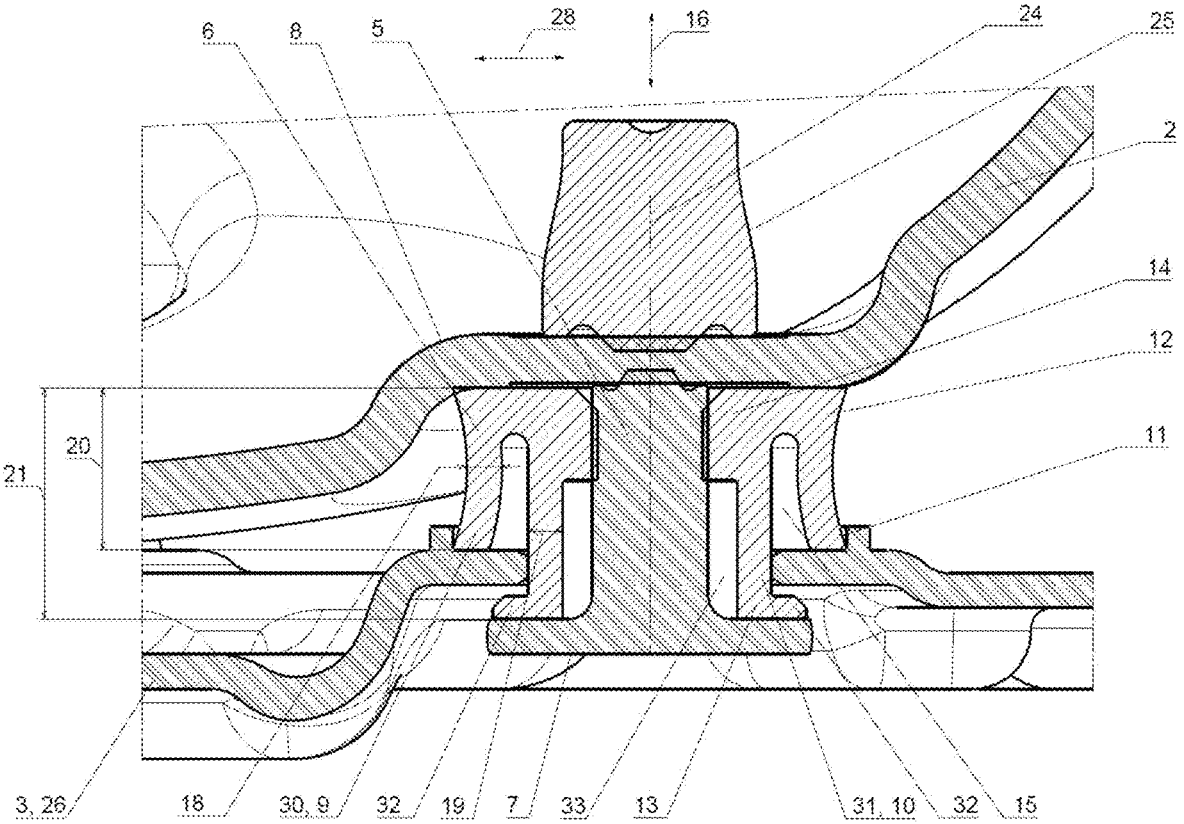
FIG. 3 shows a sectional view of an embodiment of a connection component according to the invention in an unloaded state, where the section view is analogous to FIG. 2.
Figure 4:
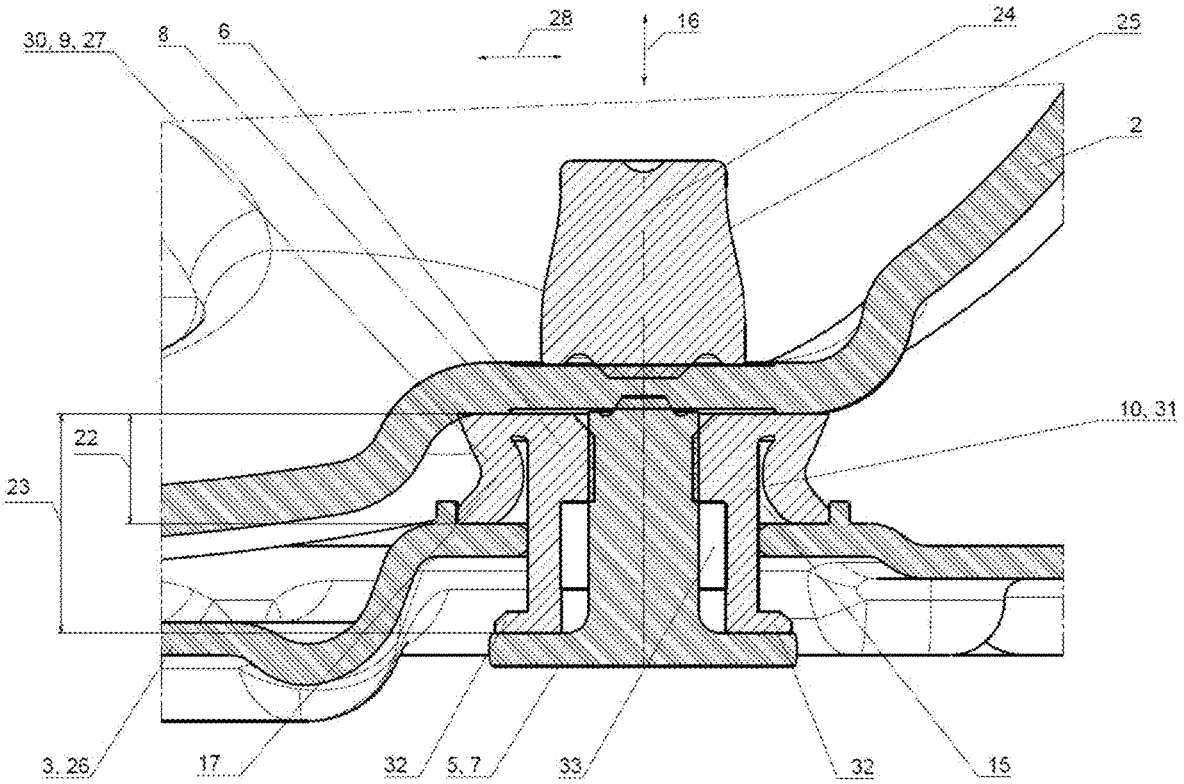
FIG. 4 shows a sectional view as in FIG. 3, where the connection component is in a loaded state.

The vibrational decoupling between refrigerant compressor 1 and refrigerator 3 is dramatically improved by connection components 4 according to the invention. FIGS. 3 and 4 show a first embodiment variation of such a connection component 4 according to the invention in a sectional view analogous to FIG. 2. Here FIG. 3 shows the connection component 4 according to the invention in an unloaded state without a compressive component parallel to axial direction 16. FIG. 4 on the other hand shows the connection component 4 according to the invention in a loaded state with at least one compressive component parallel to axial direction 16, so that the housing 2 and the mounting panel 26 are pressed against each other parallel to axial direction 16.

The outer element 6 is preferably made of rubber or an elastomer with low or zero compressibility. The inner element 5 is preferably made of metal, for example steel or stainless steel.

The outer element 6 has an outer segment 9 and an inner segment 10, where the inner segment 10 is disposed nearer to the inner element 5. Looking outward in transverse direction 28 from the lengthwise axis 24, the outer segment 9 is disposed behind the inner segment 10. In the axial direction 16 the outer segment 9 is delimited by a first end region 11 and a second end region 12. The inner segment 10 is delimited in the axial direction 16 by a first end region 13 and a second end region 14. The outer segment 9 and the inner segment 10 are connected to each other in the region of their second end regions 12, 14. Preferably, the outer element 6 is made in one piece.

In the embodiment example that is shown the segments 9, 10 exhibit symmetry about the lengthwise axis 24, so that each of the outer segment 9 and the inner segment 10 has at least in part a circular cross section normal to the lengthwise axis 24. The transverse direction 28 can, therefore, also be viewed as a radial direction in this embodiment example. Basically, however, other cross-sectional shapes are also possible, of course, for example an elliptical shape or four-sided shape, in particular rectangular or square.

The outer element 6 is connected to the inner element 5. Preferably, the outer element 6 is connected to the inner element 5 by a press fit in the region of the second end region 14 of the inner segment 10. In the embodiment example that is shown, looking in the axial direction 16, an additional gap 33 joins the press fit, the additional gap 33 thus being formed in part between the inner element 5 and the inner segment 10 of the outer element 6. Or rather, the additional gap 33 serves to prevent a direct contact between the inner element 5, the inner segment 10, and the mounting panel 26. The additional gap 33 allows the inner segment 10 to move when the mounting panel 26 presses against the inner segment 10 parallel to transverse direction 28 in the direction of inner element 5. Otherwise, a quite significantly increasing undesired transverse stiffness would result if the outer element 6 is made of rubber, since rubber is nearly incompressible.

The segments 9, 10 in this embodiment example are supported by their second end regions 12, 14 at housing 2. Preferably, the outer element 6 is supported in the region of the second end regions 12, 14 at the bottom 8 of the housing.

The outer segment 9 forms a functional segment 30, where the outer segment 9 is not only supported at housing 2, but also is supported with its first end region 11 at the mounting panel 26 of the refrigerator 3, at least in the loaded state of the connection component 4. The first end region 13 of the inner segment 10 on the other hand protrudes through the opening 29 of the mounting panel 26. The first end region 13 of the inner segment 10 is thus movable in the axial direction 16 relative to mounting panel 26 and vice versa.

This has the result that in the loaded state, when the housing 2 or the housing bottom 8 and the mounting panel 26 approach each other in the axial direction 16, only the outer segment 9 or the functional segment 30 becomes subjected to pressure in the axial direction 16. In this case the outer segment 9 is designed so that a deformation of the outer segment 9 due to buckling occurs. That is, in the loaded state the outer segment 9 or the functional segment 30 is a deformed segment 27 and has a bend 17; see FIG. 4. The inner segment 10 on the other hand is not subject to pressure in the axial direction 16, since its first end region 13 in the loaded state simply becomes, or is, shifted parallel to the axial direction 16 with respect to the mounting panel 16 [sic; 26]. Correspondingly, the inner segment 10 is also not deformed in the loaded state.

Because of the deformation of the outer segment 9 or the functional segment 30 there is a change of its length in the axial direction 16. That is, its length 20 is greater in the unloaded state than its length 22 in the loaded state. On the other hand, the inner segment 10 has a length 23 in the loaded state that is exactly the same size as a length 21 of the inner segment 10 in the unloaded state.

In the unloaded state (FIG. 3) a free space in the form of a gap 15 is formed in part between the outer segment 9 and the inner segment 10, the free space extending at least in part in a circular shape around the lengthwise axis 24, due to the symmetry present in the embodiment example that is shown. Said gap 15 offers space for the outer segment 9 or the functional segment 30 to be able to bend in the direction of the inner segment 10 in the loaded state (FIG. 4). Correspondingly, the gap 15 is partly filled by the outer segment 9 in the loaded state.

The buckling can, in each case according to how great the pressure component parallel to the axial direction 16 is, take place until the outer segment 9, or the functional segment 30, abuts an abutment member 31. In the embodiment example in FIGS. 3 and 4 the abutment member 31 is formed by the inner segment 10. Said abutting stabilizes the functional segment 30, or the outer segment 9, or the outer element 6.

All in all, a nonlinear spring constant curve of the connection component 4 according to the invention thus results. Here the outer element 6, or the outer segment 9, or the functional segment 30, can be designed so that relatively low pressures parallel to the axial direction 16 already lead to a buckling of the outer segment 9 or the functional segment 30. This corresponds to a relatively unstable state or to a very flat spring constant curve. As soon as the outer segment 9 or the functional segment 30, however, abuts the inner segment 10 or the abutment member 31, the outer segment 9 becomes stabilized. This occurs with a further increase of pressure, so that a considerably steeper characteristic curve is realized at said pressures and, all in all, a nonlinear spring constant curve of the connection component 4 according to the invention results.

How great the buckling occurs as a function of the magnitude of the pressure component parallel to the axial direction 16 or how unstable the connection component 4 is at relatively low pressures can be established, among other ways, by the choice of a wall thickness 18 of the outer segment 9. Here the wall thickness 18 can also turn out to be considerably greater than a wall thickness 19 of the inner segment 10. The wall thicknesses 18, 19 are preferably measured in the unloaded state; see FIG. 3.

Figure 5:
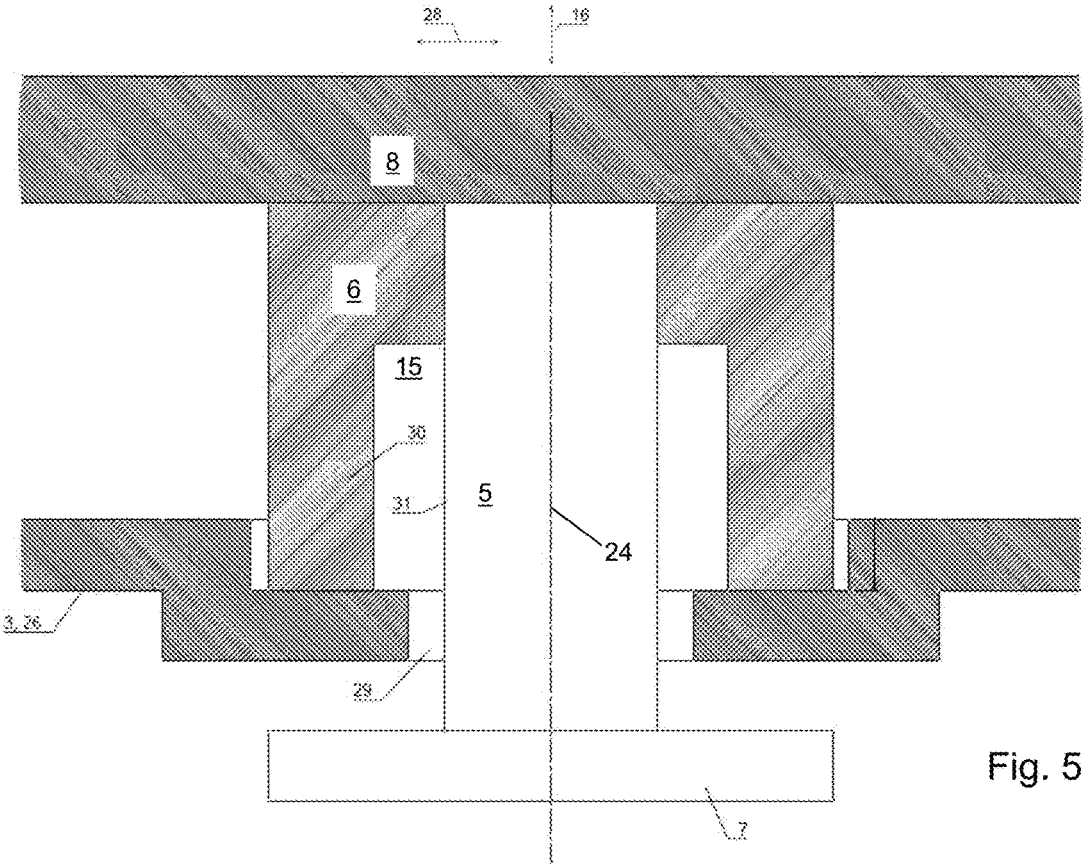
FIG. 5 shows a sectional view through another embodiment of a connection component according to the invention in an unloaded state, where the section view is analogous to FIG. 2.
Figure 6:
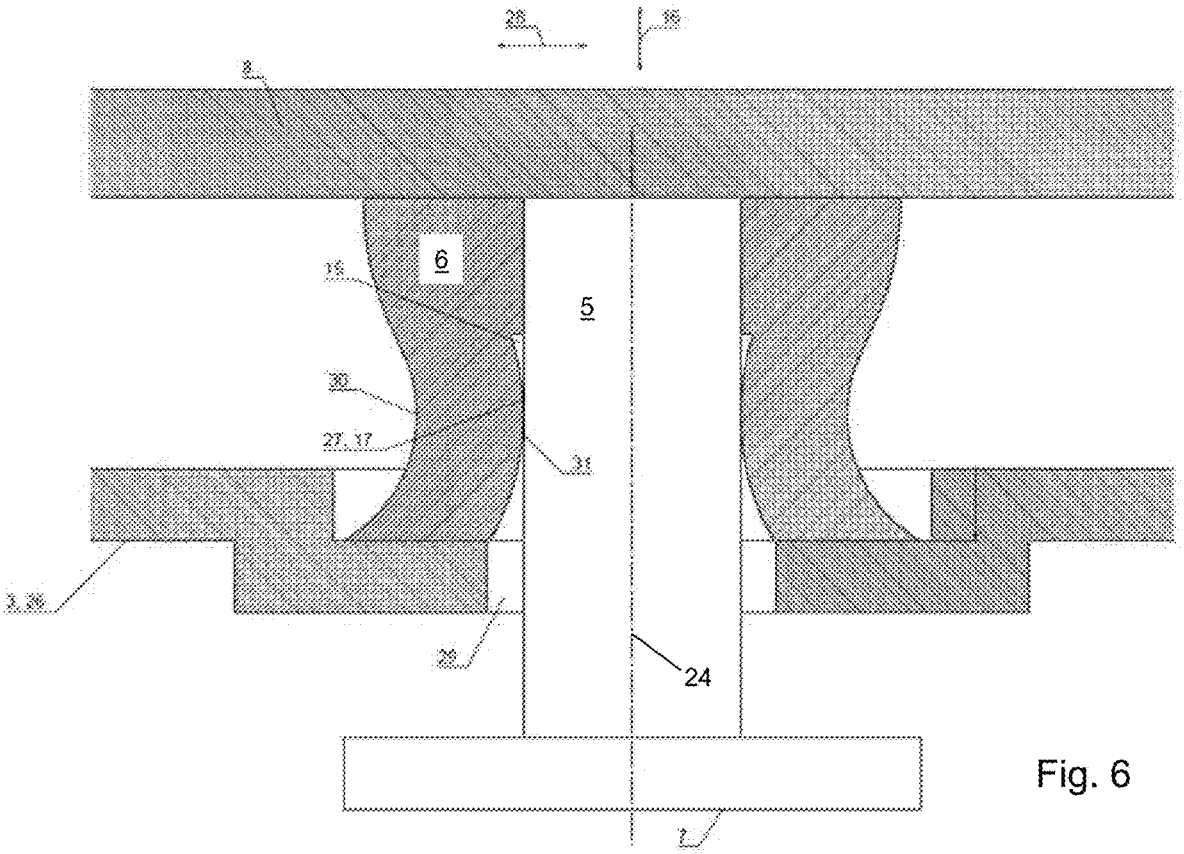
FIG. 6 shows a sectional view as in FIG. 5, where the connection component is in a loaded state.

The embodiment of the connection component 4 according to the invention shown in FIGS. 5 and 6 differs from the embodiment in FIGS. 3 and 4 essentially in that the outer element 6 has only the functional segment 30 instead of the two segments 9, 10. The functional segment 30 is supported at least in the loaded state of the connection component 4 both at the housing 2 and at the housing bottom 8 as well as at the device 3 or at the mounting panel 26.

The abutment member 31 in this case is formed by the inner element 5, which protrudes through the opening 29 of the mounting panel 26 in the axial direction 16.

This has the result that in the loaded state, when the housing 2 or the housing bottom 8 and the mounting panel 26 come nearer to each other in the axial direction 16, only the outer element 6 or the functional segment 30 becomes subject to pressure in the axial direction 16. Here the outer element 6 or the functional segment 30 is designed so that a deformation of the functional segment 30 due to buckling occurs. That is, in the loaded state the functional segment 30 is a deformed segment 27 and has a bend 17; see FIG. 6. The inner element 5, on the other hand, is not subject to pressure in the axial direction 16, since it, as already noted, protrudes through the opening 29 and thus in the loaded state is or becomes shifted parallel to the axial direction 16 with respect to the mounting panel 26.

The gap 15, which is free in the unloaded state of the connection component 4 and provides the necessary space for the deformation or the buckling of the functional segment 30 in the loaded state of the connection component 4, is correspondingly developed in part between the inner element 5 and the outer element 6 or the functional segment 30.

The buckling can, in each case according to how great the pressure component parallel to the axial direction 16 is, take place until the functional segment 30 abuts the abutment member 31 or the inner element 5. This abutting stabilizes the functional segment 30 or the outer element 6.

The opening 29 is preferably disposed in a stepped segment of the mounting panel 26, in which stepped segment the outer element 6 is disposed. Through the stepped shape the functional segment 30 is supported in the transverse direction 28 at its end that contacts the mounting panel 26 in the loaded state of the connection component 4, when the functional segment 30 buckles into the gap 15.

The cushioning layer 32 on the transport securing means 7 is not specially shown in FIGS. 5 and 6. However, of course such a layer can be provided, for example by coating the transport securing means 7 with rubber or otherwise an elastic or cushioning material.

REFERENCE NUMBER LIST

1 Refrigerant compressor
2 Housing
3 Refrigerator
4 Connection component
5 Inner element
6 Outer element
7 Transport securing means
8 Housing bottom
9 Outer segment of the outer element
10 Inner segment of the outer element
11 First end region of the outer segment
12 Second end region of the outer segment
13 First end region of the inner segment
14 Second end region of the inner segment
15 Gap
16 Axial direction
17 Bend
18 Wall thickness of the outer segment
19 Wall thickness of the inner segment
20 Length of the outer segment in the unloaded state
21 Length of the inner segment in the unloaded state
22 Length of the outer segment in the loaded state
23 Length of the inner segment in the loaded state
24 Lengthwise axis of the connection component
25 Steel spring bolt
26 Mounting panel
27 A segment having a deformation or a bend
28 Transverse direction
29 Opening in mounting panel
30 Functional segment
31 Abutment member
32 Cushioning layer over the transport securing means
33 Additional gap
34 Extent of the opening in the mounting panel in the transverse direction
35 Extent of the transport securing means in the transverse direction

The invention claimed is:

1. A connection component of a refrigerant compressor for joining a housing of the refrigerant compressor to a device that is in operative connection with the refrigerant compressor, the connection component comprising an inner element and an outer element surrounding the inner element, where the inner element has a higher stiffness than the outer element and where the outer element has a functional segment, which is designed so that in a loaded state of the connection component it is supported both at the housing and at the device, where in the loaded state a relative movement between the housing and the device and parallel to an axial direction exits and compressive load parallel to the axial direction prevails, where a free space is provided, which, looking in a transverse direction joins the functional segment of the outer element, where the inner element and the outer element, looking parallel to the transverse direction, are disposed one behind the other and where in the loaded state of the connection component the functional segment is deformed so that it at least in part protrudes into the free space, characterized in that the outer element has an inner segment disposed closer to the inner element and an outer segment, where the functional segment is formed by one of the two segments and of the two segments only the functional segment is supported both at the housing and at the device in the loaded state, and in that in the loaded state of the connection component, the deformed functional segment abuts at least in part an abutment member of the connection component which abutment member, looking in the transverse direction, abuts the free space.

2. The connection component as in claim 1, characterized in that the deformed functional segment comprises a segment with a bend, where the segment of the functional segment having the bend at least partially protrudes into the free space.

3. The connection component as in claim 1, characterized in that the abutment member of the connection component is formed by the inner element.

4. The connection component as in claim 1, characterized in that the free space is formed at least in part between the inner segment and the outer segment.

5. The connection component as in claim 4, characterized in that the abutment member is formed by the other one of the two segments.

6. The connection component as in claim 1, characterized in that the functional segment, looking in the transverse direction, has at least in part a greater wall thickness than the other one of the two segments.

7. The connection component as in claim 1, characterized in that the functional segment in the unloaded state of the connection component has, looking in an axial direction, a shorter length than the other one of the two segments, where the transverse direction runs transverse to the axial direction.

8. The connection component as in claim 1, characterized in that the functional segment, looking in an axial direction, has in the unloaded state of the connection component a greater length than in the loaded state of the connection component, where the transverse direction runs transverse to the axial direction.

9. The connection component as in claim 1, characterized in that the functional segment is formed by the outer segment.

10. The connection component as in claim 1, characterized in that the two segments are joined to each other.

11. The connection component as in claim 1, characterized in that the outer element is made in one piece.

12. The connection component as in claim 1, characterized in that the outer element is made of rubber or an elastomer.

13. A refrigerant compressor, comprising a hermetically sealed housing and a drive unit having a piston-cylinder unit for cyclic compression of a refrigerant and an electric motor to drive the piston-cylinder unit, which are disposed within the housing, where the refrigerant compressor further comprises at least one connection component as in claim 1 to join the housing to a device that is in operative connection with the refrigerant compressor.

14. A system comprising a refrigerant compressor as in claim 13 and a device that is in operative connection with the refrigerant compressor, where the device comprises a mounting panel, to which the housing of the refrigerant compressor is joined with the at least one connection component, where in the loaded state of the connection component the functional segment is supported both at the housing and at the mounting panel.

15. The system as in claim 14, characterized in that an opening and/or a recess and/or a step is provided in the mounting panel, into which the abutment member protrudes in the loaded state of the connection component.

16. The connection component as in claim 1, wherein the device comprises a mounting panel of a refrigerator.

17. The connection component as in claim 10, characterized in that the two segments are joined to each other in the region of an end region of the relevant segment.

18. The refrigerant compressor as in claim 13, wherein the device comprises a mounting panel of a refrigerator.

19. The system as in claim 14, wherein the refrigerant compressor comprises a refrigerator.

* * * * *